US007946089B2

(12) United States Patent
LaLonde

(10) Patent No.: US 7,946,089 B2
(45) Date of Patent: May 24, 2011

(54) SINGLE WEB GRID WITH REINFORCED BULB

(75) Inventor: Paul D. LaLonde, Highland Park, IL (US)

(73) Assignee: USG Interiors, Inc., Chicago, IL (US)

( * ) Notice: Subject to any disclaimer, the term of this patent is extended or adjusted under 35 U.S.C. 154(b) by 96 days.

(21) Appl. No.: 12/187,462

(22) Filed: Aug. 7, 2008

(65) Prior Publication Data

US 2008/0289280 A1 Nov. 27, 2008

Related U.S. Application Data

(62) Division of application No. 11/535,546, filed on Sep. 27, 2006, now abandoned.

(51) Int. Cl.
*E04B 9/06* (2006.01)

(52) U.S. Cl. ..... 52/506.07; 52/506.06; 52/506.01; 29/897.31; 29/897.312

(58) Field of Classification Search ..... 52/506.01, 52/506.06, 506.07; 29/897.31, 897.312
See application file for complete search history.

(56) References Cited

U.S. PATENT DOCUMENTS 683,996 A 10/1901 Schmeltzer
1,407,242 A 2/1922 Wylie
1,457,303 A 6/1923 Higgins
2,065,378 A 12/1936 Kling
3,043,408 A 7/1962 Attwood
3,159,252 A 12/1964 Cotts
3,369,332 A * 2/1968 Harlan ..... 52/98
3,370,301 A 2/1968 Harlan
3,595,056 A 7/1971 Hutton
3,832,816 A 9/1974 Jahn
3,898,784 A 8/1975 Sauer et al.
4,206,578 A * 6/1980 Mieyal ..... 52/506.07
4,329,824 A 5/1982 Lowe
RE31,528 E 3/1984 Mieyal
4,455,806 A 6/1984 Rice
4,490,958 A 1/1985 Lowe
4,520,609 A * 6/1985 Worley et al. ..... 52/506.07
4,535,580 A 8/1985 Shirey
4,691,494 A 9/1987 Gwynne
4,852,325 A 8/1989 Dunn et al.
4,932,186 A * 6/1990 Jahn ..... 52/506.07
5,501,053 A 3/1996 Goleby
6,436,552 B1 8/2002 Walker et al.
7,516,585 B2 * 4/2009 Lehane et al. ..... 52/506.07

* cited by examiner

*Primary Examiner* — Eileen Lillis
*Assistant Examiner* — Alp Akbasli
(74) *Attorney, Agent, or Firm* — Pearne & Gordon LLP

(57) ABSTRACT

Manufacture of roll formed one piece sheet metal grid tees that affords different load ratings with the same gauge and quality of sheet stock and the same overall cross-section dimensions by varying the width of the strip used to make the tees and disposing material added for increased load rating at the area of the hollow reinforcing bulb of the tees.

4 Claims, 2 Drawing Sheets

SINGLE WEB GRID WITH REINFORCED BULB

The invention relates to grid tees for suspended ceilings and, in particular, to an improved grid tee construction and method of its production.

PRIOR ART

Suspended ceilings typically use a rectangular metal grid made up of main runners and cross runners. The grid supports ceiling panels or tiles normally laid onto the upper faces of runner or tee flanges or, less commonly, large panels are screwed to lower faces of the flanges. The runners commonly have an inverted T-shaped cross-section and are typically roll-formed from strips of sheet metal. The lower flange portions of the tee section extend horizontally from both sides of a vertical central web. The upper edge of the web is conventionally reinforced with a hollow bulb.

The grid runners or tees are supplied in different strengths, e.g. intermediate and heavy duty, to satisfy the requirements of a particular installation. The specified strength or rating can depend, for example, on the use of a space below the ceiling, seismic conditions, and so forth. The industry currently recognizes an intermediate duty load rating and a higher capacity "heavy duty" load rating.

The cross-sectional geometry of conventional grid tee runners is relatively standard, commonly being 1-½" high, 15/16" wide and having a reinforcing bulb width of ¼". Suspended ceiling grid is in a near commodity status and sales of the same can be largely price driven. Therefore, it is imperative for a manufacturer to put no more material, i.e. steel, in the product, than is necessary to meet a customer's needs. The strength of a grid tee is directly related to the gauge or thickness of the sheet metal used in its production. Where a lighter duty product is being made, a lighter or thinner gauge sheet metal stock can be used and where a heavier duty product is called for, a heavier gauge metal strip can be used to produce the grid tee. The common practice of producing different rated grid tees by changing the thickness of the stock used to make the tees has certain costs associated with the labor and manufacturing down time necessary for changing over and adjusting the roller dies that are used for different gauges of sheet stock. Additionally, a manufacturer can be forced to buy and inventory multiple gauges of sheet steel for producing grid tees of different load ratings when following prior art practices.

SUMMARY OF THE INVENTION

The invention provides a novel method for producing grid tee runners and novel runners produced by such method. The disclosed method enables a manufacturer to produce grid tees of different load ratings while having the same overall roll formed configuration and being constructed of the same gauge or thickness of sheet metal. More particularly, the invention is applicable to the inverted tee style of grid runner that has a single layer web and, ordinarily, is formed of a single strip of sheet metal. With the invention, additional strength, beyond the load capacity or rating attainable with a conventional configuration and a given gauge and quality of material is obtained by constructing the grid tee reinforcing bulb with at least a partial double layer of sheet material.

The invention approaches an ideal construction because it locates the material added for increased strength into the area of the bulb. This is advantageous since the additional material is situated as far or nearly as far as possible from the neutral axis, located near the mid-height of the web, thereby obtaining a high beam strength.

Where the double layer extends along less than the full perimeter of the reinforcing bulb, it can be arranged, more or less, on either side of the plane of the web relative to a flange construction that is half double layer and essentially half single layer. The invention, by utilizing the same gauge of material, for different duty ratings, enables the manufacturer to reduce its costs of production. The invention permits the manufacturer to keep the material content as low as practical and at the same time allows certain labor costs and machine down time to be avoided. Labor costs and machine down time are minimized since there is no need to change over the rolling dies to run different gauges of strip stock.

The invention can extend the versatility of existing tooling since it can allow manufacture of higher duty products, even though such tooling is limited to running lighter gauge material. Down time or change over time to run higher or lower duty product in a roll forming machine is virtually eliminated with the invention since the only change essentially required is that of changing the width of the stock being fed to the machine. Economy can also be gained with the invention since the material used for different load ratings need only vary in width. This enables the grid runner manufacturer to buy and inventory master coils of one gauge and to simply slit such roll stock to the widths needed. The disclosed grid can be easier to install and, therefore, has greater marketability because it is easier to field cut the web by hand with a tin snips, for example, than to cut grid tee made with heavier stock.

DESCRIPTION OF THE PREFERRED EMBODIMENT

Figure 1:
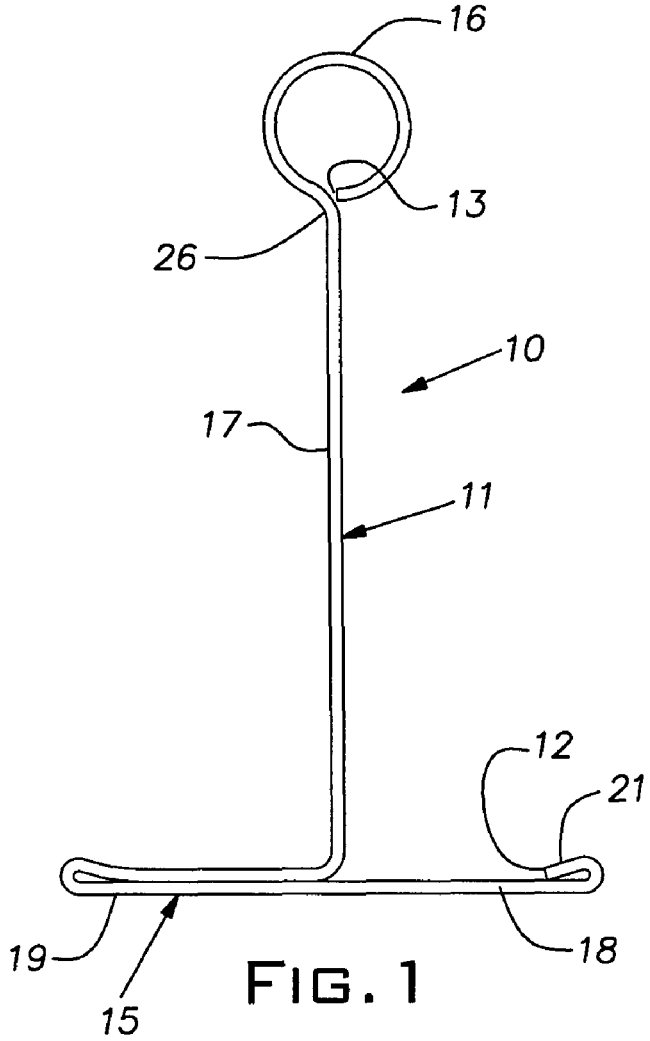
FIG. 1 is a cross-sectional view of one style of a known prior art grid tee.

The invention pertains to a method of producing sheet metal grid runners of the inverted tee style. The grid runner tees are used in construction of suspended ceilings, soffits, and like structures. FIG. 1 shows a conventional prior art grid runner tee 10 in cross-section. The grid tee or runner 10 is roll-formed from a sheet metal strip 11, such as 0.021/0.024" gauge galvanized steel, for example. It will be understood that other gauges and other metals such as aluminum can be used in practicing the invention. The tee 10 is shaped from a flat strip in a conventional roll forming machine in which rolls, sometimes referred to as dies or tooling, at successive stages or stations along the rolling direction progressively form the strip into the desired form. Material adjacent opposite edges 12, 13 of the strip 11 in this tee shape as well as those described below, can be shaped concurrently as the strip 11 progresses through the roll forming machine. The tee 10 as well as other tees disclosed herein, if it is a main tee, can have nominal lengths of 10 feet or 12 feet, and if it is a cross tee or runner, can have nominal lengths of 2 feet or 4 feet. The tee 10, apart from separately formed end connectors (not shown) fixed to its ends as is known in the art, is preferably of a one-piece construction. In use, the grid tee 10 has the configuration of an inverted letter T with a lower flange 15, an upper hollow reinforcing bulb 16, and a single layer web 17 connecting the flange 15 to the bulb 16. The illustrated tees in the various figures are customarily, suspended by wires from overlying superstructure and looped through holes in the web, can be used with ceiling panels or tiles laid-in on top faces of the flanges 15 or with drywall or like panels screwed to the bottom faces of the flanges.

The various grid tees disclosed herein preferably though not necessarily, have industry standard overall dimensions. If standard, the lower face of the flange 15 is nominally 15/16" wide, the height of the bulb from the flange is 1-½" and the bulb width is ¼". Some commercially used grid tees of other constructions have taller tees of, for example, 1-⅝". In the style of grid tee shown in FIG. 1, as is conventional, the web 17 is a single, planar and vertical layer. The flange 15 has its width centered on the plane of the web 17 but is asymmetrical with respect to the web by virtue of having at one side of the web one portion 18 of a generally single layer, being associated with the edge 12 and, on the opposite side of the web another portion 19 with a double layer. A hem at the edge 12, being folded onto the main part of the portion 18, forms a minor double layer area on this flange portion 18.

The illustrated reinforcing bulb 16 has a generally circular cross-section with its center at the plane of the web 17 so that it is symmetrically arranged over the web. As shown, the bulb cross-section is substantially a fully closed circle with the edge 13 closely adjacent or contacting a zone 26 where the sheet or strip of metal 11 making the tee 10 transitions between an upper region of the web 17 and the bulb 16. This zone 26 is displaced, measuring along the body of the strip 11 in the width-wise direction of the strip, a distance from the edge 13 about the same as the circumference of the bulb 16.

As mentioned, FIG. 1 represents the configuration of a prior art grid tee 10. In the remaining FIGS. 2-7, the hollow reinforcing bulb and upper region of a web are depicted and it will be understood that the lower part of the respective tee cross-sections is similar or identical to that shown in FIG. 1.

Figure 2:
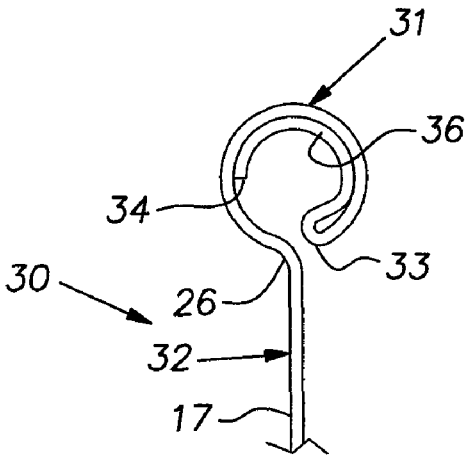
FIG. 2 is a fragmentary cross-sectional view of the upper part of a grid tee modified in accordance with the invention.

FIG. 2 illustrates the upper portion of a grid runner or tee 30 with a modified reinforcing bulb 31. Comparison of FIG. 2 with FIG. 1 shows that the width of the metal strip, designated 32, used to make the tee 30 is somewhat greater than the width of the strip 11 used to make the tee 10, it being understood that nominal dimensions of the tees, including the widths of the reinforcing bulbs is the same. The additional width of strip material 36 measured from a fold line 33 to an edge 34 is turned back on the remainder of the strip 32 by roller dies and then a hollow bulb 31 is roll-formed in the same manner and same roller dies as those used to form the bulb 16 of the tee 10 of FIG. 1. The additional width of material is situated in the bulb 31 and follows the contour and abuts the adjacent portion of the inner periphery of the bulb 31. The result is that the bulb 31 has a partial double wall provided by the folded-over material 36. The reinforcing bulb 31, ideally, has external dimensions essentially identical to those of the hollow bulb 16 of the grid tee 10.

Figure 3:
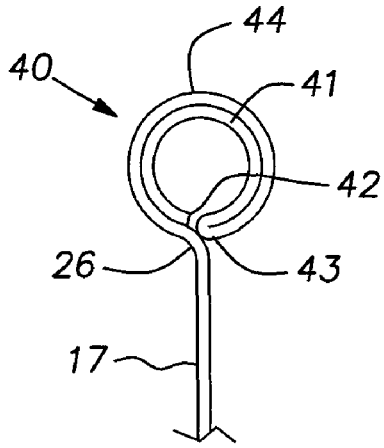
FIG. 3 is a fragmentary cross-sectional view of the upper part of a grid tee in accordance with another modification of the invention.

In FIG. 3 an upper part of another version of a tee 40 is shown. A strip of material 41 wider than the strip 11 of FIG. 1 and the strip 32 of FIG. 2, is used to make the tee 40. Extra material measured from an edge 42 to a fold line 43 adjacent the transition 26 from the web 17 to a hollow bulb 44 is provided. The additional width of material 41, like the material 36 of the grid tee 30 of FIG. 2, abuts an inner surface of an outer layer or wall of the bulb 44 and, in this version, provides a substantially full double layer bulb, i.e. the full circumferential extent of the bulb comprises a double layer of metal sheet stock.

Figure 4:
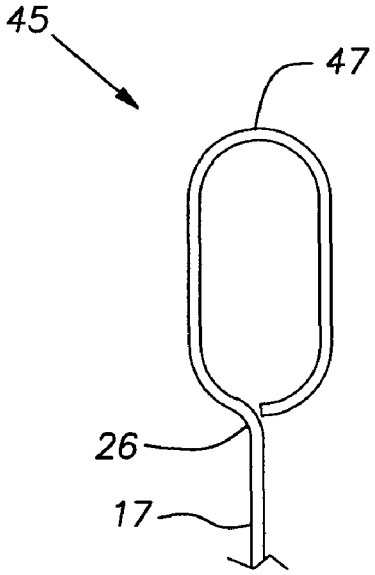
FIG. 4 is a fragmentary cross-sectional view of another form of a grid tee with a single layer bulb.
Figure 5:
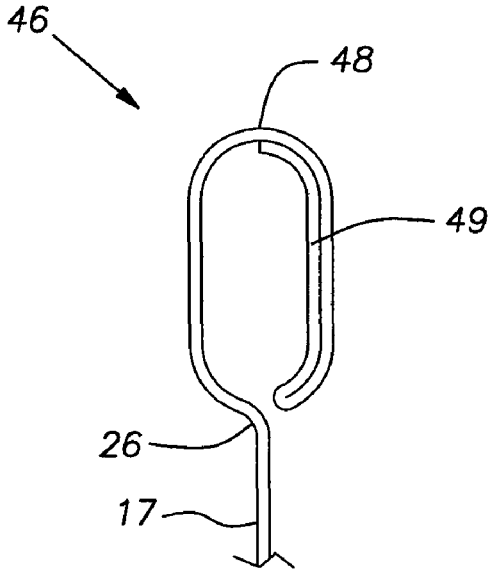
FIG. 5 is a fragmentary cross-sectional view of the upper part of a grid tee in accordance with still another modification of the invention.

FIGS. 4 and 5 illustrate grid tees 45, 46 with hollow reinforcing bulbs 47, 48 that have oval or O-shaped cross-sections. Comparison of FIG. 5 with FIG. 4 shows that the same concept of making a reinforcing bulb 46 with a partial double layer 49 is applicable to bulb configurations other than the round configuration of FIGS. 1-3. Sometimes in practice, the double wall portion 49 may spring away from the outer bulb wall towards the center of the bulb 48 but this condition does not appear to significantly adversely affect the performance of the tee 46. An oval bulb configuration with a full double layer is also contemplated.

Figure 6:
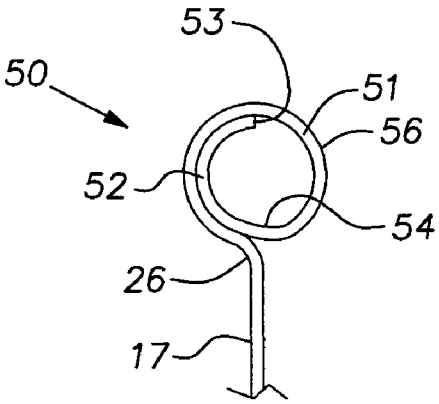
FIG. 6 is a fragmentary cross-sectional view of the upper part of a grid tee in accordance with a further modification of the invention.

FIG. 6 illustrates the upper portion of still another form of grid tee 50. The grid tee 50 includes a hollow bulb 51 that is circular and has a partial double layer 52 formed by an additional strip width portion existing between an edge 53 and a point 54 adjacent the transition zone 26. While not shown, it is contemplated that a tee similar to the tee 50 can be formed with a full double layer extending about the full inner periphery of the bulb. In either the case of FIG. 6 or a tee with a similar double layer or wall, the additional layer is in a scroll-like relation with the outer layer, designated 56 of the bulb 51. The hollow reinforcing bulb 51 with a partial or full double layer is made on the same roll-forming dies that can be used to form the tee 10 of FIG. 1, the double layer section 55 of the reinforcing bulb being rolled prior to the formation of the outer bulb layer 56. Again, the double layer bulb style grid tee can be made in a production run on the roll-forming line using a specific width of a strip of a given thickness and the single layer version of the tee can be made on the same line with a narrower strip of the same thickness during a different production run.

Figure 7:
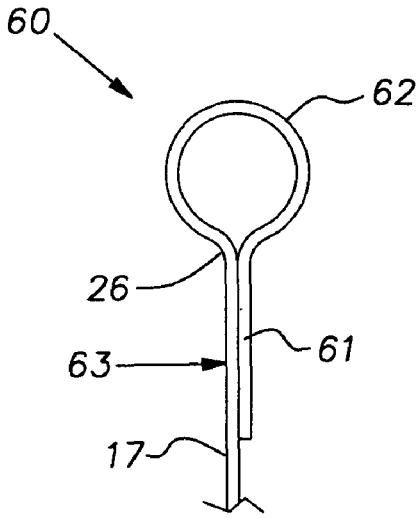
FIG. 7 is a fragmentary cross-sectional view of the upper part of a grid tee in accordance with a still further modification of the invention.

FIG. 7 illustrates a grid tee 60 modified from the grid tee 10 of FIG. 1 by the addition of a tag element 61 that is integral with a hollow reinforcing bulb 62. Analogous to the previously described grid tees, the grid tee 60 can be manufactured in production runs on the same roll forming line used in producing the grid tee 10 by increasing the width of a strip 63 of metal from the width of the strip 11 used to make the tee 10 while using a sheet metal gauge or thickness of essentially the same dimension.

In the grid tee constructions of FIGS. 2, 3, and 5-7, additional width of a metal strip is associated with a hollow reinforcing bulb to increase the duty rating of the respective tee. In general, particularly where the additional material is disposed within the reinforcing bulb, the increase in strength can be roughly proportional to the amount of additional width of stock used to generate the particular grid tee.

The invention suggests the use of an additional width of sheet metal strip stock beyond that used to form a single layer web, single layer hollow bulb grid tee, i.e. a conventional grid tee, and to dispose this additional, integral width of material as an extension of the single wall reinforcing bulb so that such extra material is disposed where it is, at least to some extent, remote from the neutral axis of the grid tee, which typically is in a central area or region of the height of a web. The invention, additionally, comprehends the production of grid tees of similar, or identical external shapes using the same gauge or material stock thickness but with different load capacities by virtue of having a reinforcing bulb of at least a partial double layer in some production runs and in other production runs a grid tee with a bulb that is essentially exclusively a single layer. As discussed, the partial or wholly double wall reinforcing bulb grid tees can be made on the same roll-forming production tooling as the grid tees such as shown in FIGS. 1 and 4 with a single layer reinforcing bulb and, desirably, with the same thickness or gauge of stock. Other shapes of reinforcing bulbs are envisioned such as square, rectangular or with an inverted V-shaped top. Similarly, other shapes of grid tees with different webs and flanges are envisioned. Common to all of the disclosed grid tees that represent modifications from a single layer reinforcing bulb is additional reinforcing material in the form of an integral, additional width of a strip directly attached to the part of the outer layer of the reinforcing bulb that, measured along the periphery of the cross-section of the bulb, is remote from the point of transition between the bulb and web.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A grid tee for a suspended ceiling, soffit, or like structure, the grid tee being of the inverted tee style and being roll-formed from a single strip of sheet metal of a selected width bounded by opposed longitudinal edges, the tee having a lower flange, an upper hollow reinforcing bulb, and a web extending between the flange and the bulb, the lower flange having portions on each side of the web that are of generally equal width, at least one of the flange portions being of a double layer, the web being of a single layer, the bulb having a boundary with a width and height, the width being generally centered over the web, at least a portion of the bulb being a double layer of the strip that increases the load rating of the tee, the strip material forming the double layer being integral with the remainder of the bulb, said double layer bulb portion including a fold at a part of a cross-section of the bulb that is remote, as measured along the cross-section, from a point where the bulb transitions with the web, the fold being inturned such that an edge of the strip lies within and is enclosed by the bulb.

2. A grid tee as set forth in claim 1, wherein said bulb is curvilinear in section.

3. A suspended ceiling grid tee as set forth in claim 2, wherein said bulb is round in cross-section.

4. A suspended ceiling grid tee as set forth in claim 2, wherein said bulb is oval in cross-section.

* * * * *